US006588167B2

(12) United States Patent
Chang

(10) Patent No.: US 6,588,167 B2
(45) Date of Patent: Jul. 8, 2003

(54) REVERSIBLE DUAL-COLOR FLOOR PAD MODULE

(76) Inventor: Kuo Chi Chang, No. 8, Lane 184, Sung Chiang Rd., Taipei (TW)

( * ) Notice: Subject to any disclaimer, the term of this patent is extended or adjusted under 35 U.S.C. 154(b) by 63 days.

(21) Appl. No.: 09/989,032

(22) Filed: Nov. 21, 2001

(65) Prior Publication Data

US 2003/0093966 A1 May 22, 2003

(51) Int. Cl.[7] ..... E04B 2/08; E04B 2/18; E04B 2/32

(52) U.S. Cl. ..... 52/590.1; 52/591.1; 52/302.1; 52/177; 428/44; 428/53

(58) Field of Search ..... 52/590.1, 177, 52/302.1, 591.1; 428/44, 53, 55, 58, 60, 81; 403/381, 339, 340, 364

(56) References Cited

U.S. PATENT DOCUMENTS

| | | | | | |
|---|---|---|---|---|---|
| 527,961 | A | * | 10/1894 | Furness | 52/590.1 |
| 964,160 | A | * | 7/1910 | Hammett | 52/590.1 |
| 1,852,715 | A | * | 4/1932 | Greenebaum | 52/392 |
| 2,099,149 | A | * | 11/1937 | Turnquist | 52/590.1 |
| 2,999,431 | A | * | 9/1961 | Mitchell | 472/92 |
| 3,909,996 | A | * | 10/1975 | Ettlinger et al. | 52/177 |
| 4,018,025 | A | * | 4/1977 | Collette | 52/302.4 |
| 4,287,693 | A | * | 9/1981 | Collette | 52/177 |
| 6,526,705 | B1 | * | 3/2003 | MacDonald | 52/177 |

FOREIGN PATENT DOCUMENTS

| | | | | |
|---|---|---|---|---|
| EP | 0329467 | * | 2/1989 | E04D/11/00 |

* cited by examiner

*Primary Examiner*—Carl D. Friedman
*Assistant Examiner*—Chi Q. Nguyen
(74) *Attorney, Agent, or Firm*—Dennison, Schultz & Dougherty

(57) ABSTRACT

A floor pad module is formed along its four edges with specially designed first and second dovetails and corresponding dovetail grooves, so that the floor pad module could be reversed without affecting its free connection to another floor pad module via engagement of the dovetails with the dovetail grooves. This enables the floor pad module to be manufactured with two different colors shown at a front and a reverse side thereof, and a consumer may connect a plurality of the floor pad modules to form a large area of floor pad showing differently colored patterns simply by reversing some of the floor pad modules in the same one pack without the need of purchasing two or more packs of monochromatic floor pad modules.

4 Claims, 4 Drawing Sheets

REVERSIBLE DUAL-COLOR FLOOR PAD MODULE

BACKGROUND OF THE INVENTION

Floor pad modules are currently very popular among consumers. There are many different designs for the connecting mechanism provided along four edges of the floor pad modules, so that the floor pad modules could be continuously connected to one another at all four edges to provide a large area of floor pad. A common feature for these conventional floor pad modules is that they must be connected to one another with a front side thereof always facing the same side. When any one module included in a pack of the same floor pad modules is turned upside down, it would fail to engage the connecting mechanism along its four edges, such as a series of tenons, with mortises provided along the edges of other modules that are not reversed. Due to this limitation, the conventional irreversible floor pad modules are usually produced to show the same color at two sides thereof, and consumers have to purchase two or more packs of differently colored floor pad modules to enable formation of a large area of combined floor pad showing one or more colored patterns. In other words, the consumers have to expend more money to buy more packs of differently colored floor pad modules to produce desired color patterns on their combined floor pad while they do not actually need so many floor pad modules. This is, of course, an unnecessary waste to the consumers.

It is therefore tried by the inventor to develop a reversible floor pad module showing two different colors at two sides thereof, so that consumers may freely reverse any one of the reversible floor pad modules included in the same one pack to form colored patterns on the connected floor pad modules without encountering the problem of unmatched connecting mechanisms. The reversible floor pad modules enables the floor pad modules to be produced with two different colors at two sides thereof, so that consumers need only to buy one pack of floor pad modules to obtain a large area of combined floor pad showing two different colors. The reversible dual-color floor pad modules also enable manufacturers to carry a reduced stock of finished products of the floor pad modules to save warehousing space thereof.

SUMMARY OF THE INVENTION

A primary object of the present invention is to provide a reversible dual-color floor pad module that includes a square body being provided along each edge of a first pair of two opposite edges with alternate first dovetails and corresponding dovetail grooves, such that the number of the first dovetails is N, which is a natural number larger than 1, and the number of the corresponding dovetail grooves is N+1; the square body also being provided along each edge of a second pair of two opposite edges with spaced second dovetails and first dovetails, and corresponding dovetail grooves between two adjacent first and second dovetails or two adjacent first dovetails, such that the total number of the first and the second dovetails, and the number of the corresponding dovetail grooves at each edge of the second pair of two opposite edges are N+1 and N, respectively. With these arrangements, the floor pad module could be reversed without affecting the connection of it to any other floor pad module that is not reversed. Thus, the floor pad module may be produced with two sides thereof showing two different colors. A consumer needs only to buy one pack of floor pad modules to obtain a combined floor pad showing different color patterns.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
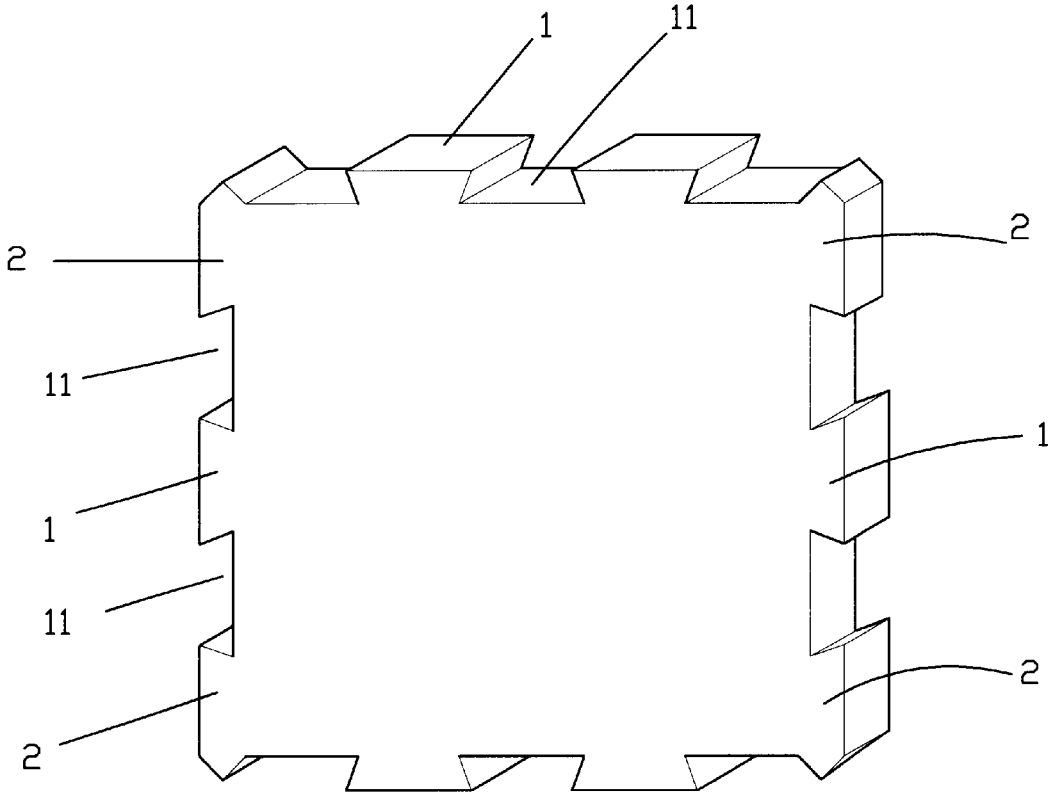
FIG. 1 is a perspective view of a reversible dual-color floor pad module according to the present invention.

Please refer to FIG. 1 that shows a reversible dual-color floor pad module according to the present invention. The module is a square body provided along each edge of a first pair of two opposite edges with alternate first dovetails land corresponding dovetail grooves 11, such that when a number of the first dovetails 1 is N, which is a natural number larger than 1, a number of the dovetail grooves 11 is N+1. The square body of the module is further provided along each edge of a second pair of two opposite edges with sequentially spaced second dovetails 2 and first dovetails 1, such that a corresponding dovetail groove 11 is formed between two adjacent dovetails 1, 2 or 1, 1. A total number of the first dovetails 1 and the second dovetails 2, and a number of the corresponding dovetail grooves 11 at each edge of the second pair of two opposite edges are N+1 and N, respectively.

Figure 2:
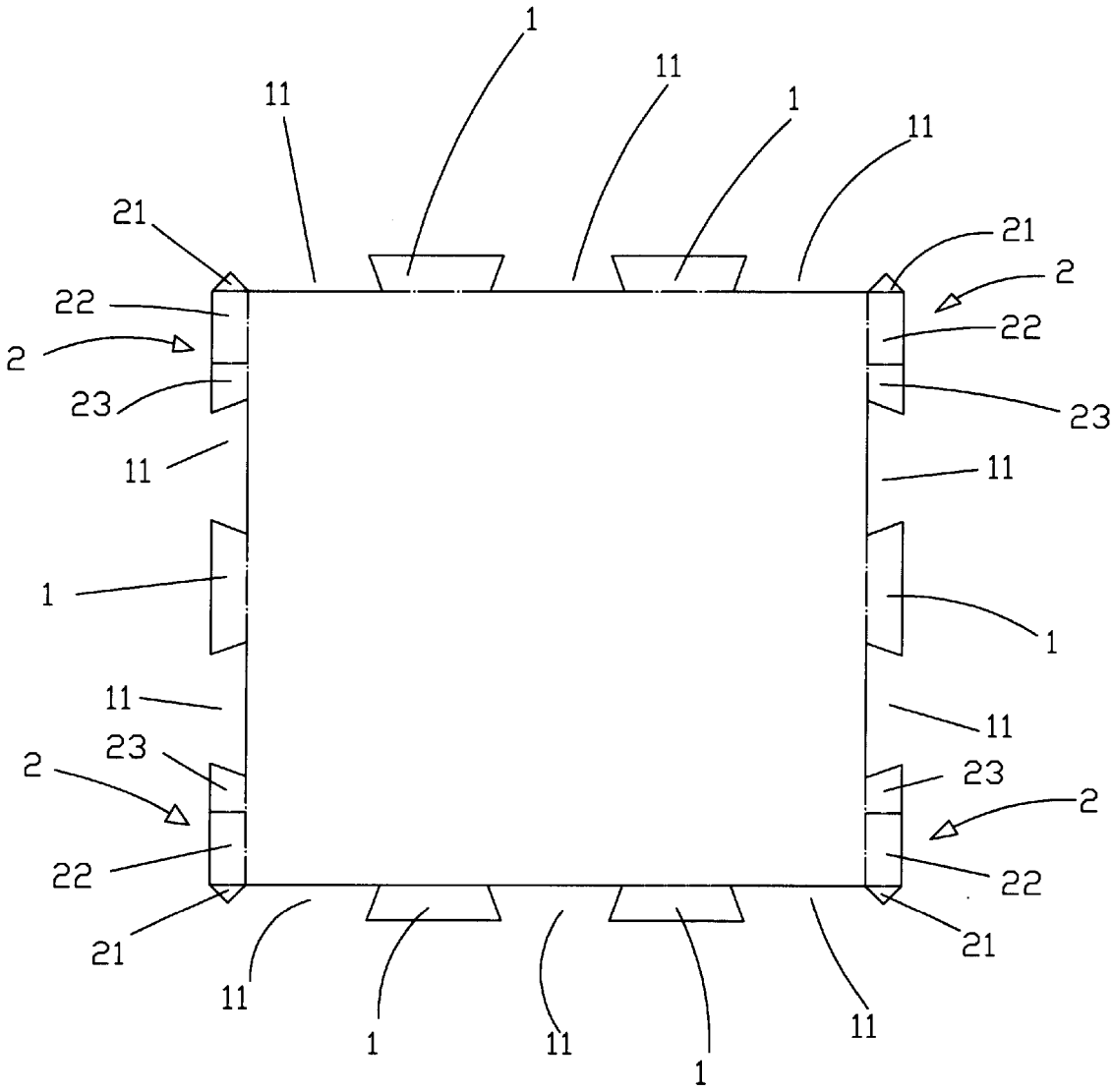
FIG. 2 is a plan view of the floor pad module of FIG. 1.

The second dovetails 2 are always located at four corners of the square module. Please refer to FIG. 2. Each of the second dovetails 2 is integrally formed from a triangle 21, a rectangle 22, and a trapezoid 23. The triangle 21 is connected at a base to one shorter side of the rectangle 22, which is then connected at another shorter side to a vertical side of the trapezoid 23. The shorter side of the rectangle 22 connected to the base of the triangle 21 is flush with one of the first pair of two opposite edges that is adjacent to the rectangle 22, so that the triangle 21 is projected from that adjacent edge. The other side of the trapezoid 23 opposite to the rectangle 22 has an inclination corresponding to that of two sides of the first dovetail 1 adjacent to the second dovetails 2.

The first dovetails 1 formed at the second pair of two opposite edges of the square module have a shape identical to that of the first dovetails 1 formed at the first pair of two opposite edges of the square module; and the dovetail grooves 11 have a shape inverse to that of the first dovetails 1. Moreover, the number of the dovetail grooves 11 on each edge of the second pair of two opposite edges of the square module is the same as the number of the first dovetails 1 on each edge of the first pair of two opposite edges.

Figure 3:
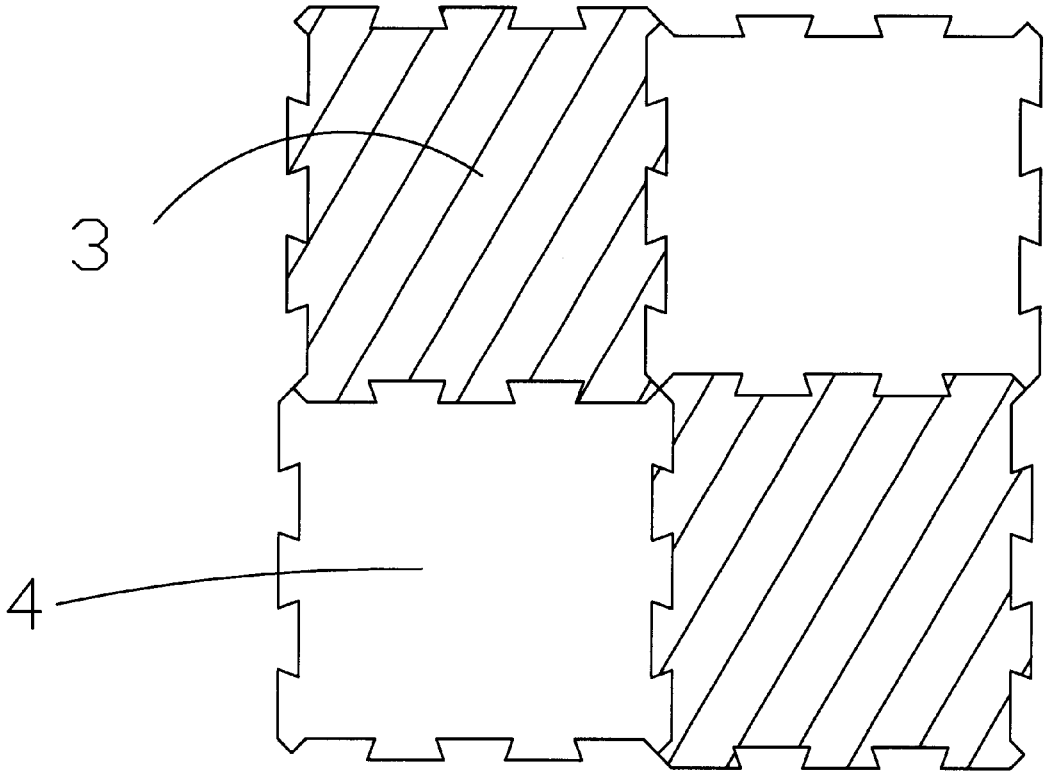
FIG. 3 is an example of combination of four reversible dual-color floor pad modules of the present invention to show two colors alternately.
Figure 4:
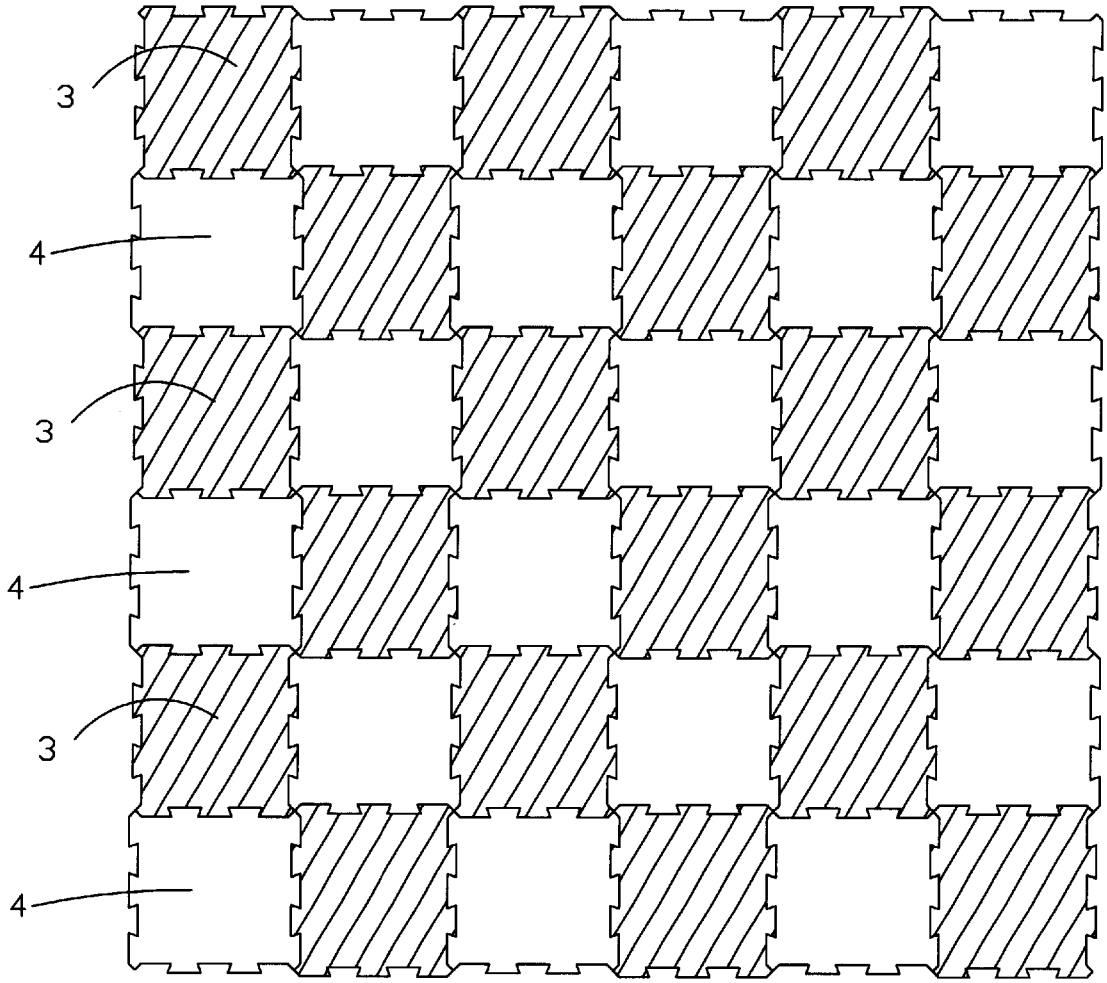
FIG. 4 is another example of combination of multiple reversible dual-color floor pad modules of the present invention to show two colors alternately.

With the above arrangements, the square floor pad module of the present invention may be produced and cut into shape with two different colors at front and reverse sides thereof. For example, the square floor pad module may be red 3 at the front side and blue 4 at the reverse side. When a consumer connects multiple floor pad modules together, he or she may freely reverse any module to show a different color. FIG. 3 is an example of combination of four reversible floor pad modules of the present invention to show two colors alternately; and FIG. 4 is another example of combination of multiple reversible floor pad modules of the present invention to show two colors alternately. In a similar manner, the square floor pad modules of the present invention may be freely combined and connected to show differently colored patterns. The reversible dual-color floor pad modules of the present invention are therefore more convenient and changeful for use, as compared with the conventional ones.

What is claimed is:

1. A reversible dual-color floor pad module, comprising a square body being provided along each edge of a first pair of two opposite edges with alternate first dovetails and corresponding dovetail grooves, such that a number of said first dovetails is N, which is a natural number larger than 1, and a number of said dovetail grooves is N+1; said square body also being provided along each edge of a second pair of two opposite edges with spaced second dovetails and said first dovetails, and corresponding dovetail grooves between two adjacent ones of said first and said second dovetails and two adjacent ones of said first dovetails, such that a total number of said first dovetails and said second dovetails, and a number of said dovetail grooves at each edge of said second pair of two opposite edges being N+1 and N, respectively; and said second dovetails being always located at four corners of each said square body, and each of said second dovetails being integrally formed from a triangle, a rectangle, and a trapezoid; said triangle being connected at a base to one shorter side of said rectangle, which being then connected at another shorter side to a vertical side of said trapezoid.

2. The reversible dual-color floor pad module as claimed in claim 1, wherein said shorter side of said rectangle connected to the base of said triangle is flush with one of the first pair of two opposite edges that is adjacent to said rectangle, so that said triangle is projected from said adjacent edge, and another side of said trapezoid opposite to said rectangle having an inclination corresponding to that of two sides of said first dovetail.

3. The reversible dual-color floor pad module as claimed in claim 2, wherein said first dovetails formed along each edge of said second pair of two opposite edges of said square body has a shape identical to that of said first dovetails provided along each edge of said first pair of two opposite edges of said square body.

4. The reversible dual-color floor pad module as claimed in claim 2, wherein said dovetail grooves formed on each edge of said second pair of two opposite edges of said square body has a shape inverse to that of said first dovetails provided along each edge of said first pair of two opposite edges of said square body.

* * * * *